US005768917A

United States Patent [19]

Freida

[11] Patent Number: 5,768,917

[45] Date of Patent: Jun. 23, 1998

[54] LAUNDRY BALL

[76] Inventor: Leu Shiow Jiuan Freida, No. 487, Noan Noan Street, Noan Noan District, Keelung City, Taiwan

[21] Appl. No.: 714,257

[22] Filed: Sep. 17, 1996

[51] Int. Cl.[6] ..... D06F 39/02

[52] U.S. Cl. ..... 68/17 R; 206/0.5; 510/276; 510/277; 510/439

[58] Field of Search ..... 68/17 R, 235 R; 206/0.5; 510/276, 277, 293, 295, 298, 439

[56] References Cited

U.S. PATENT DOCUMENTS 4,532,722 8/1985 Sax ..... 206/0.5 X 4,835,804 6/1989 Arnau-Munoz et al. ..... 206/0.5 X 5,355,541 10/1994 Rutter et al. ..... 68/17 R X 5,393,446 2/1995 Matsumoto ..... 510/276 X

*Primary Examiner*—Philip R. Coe

*Attorney, Agent, or Firm*—Bacon & Thomas

[57] ABSTRACT

A washing machine cleaning agent is enclosed within a porous shell which in turn is enclosed between two semi-spherical halves of a housing that are welded together, whereby the porous shell containing the agent is permitted to roll around within the housing and dissolve in the wash water.

3 Claims, 3 Drawing Sheets

LAUNDRY BALL

BACKGROUND OF THE INVENTION

1. Field of the Invention

The present invention relates to a laundry ball, and more particularly to a laundry ball configured with two semi-spherical symmetrical halves of an outer housing, a pair of annular plates and an inner porous shell for containing a plurality of solid particulate washing agent therein. The porous shell and agent are disposed within the housing halves which are attached together by two annular plates under supersonic welding to construct a laundry ball.

2. Description of the Prior Art

In the conventional washing process, a suitable quantity of cleaning agent, such as washing powder, is added into the washing machine to clean the clothing. Nevertheless, an excess amount of cleaning agent may cause a high percentage of residue to remain in the waste water as well as the clothing. Accordingly, not only will any remaining excess agent cause irritation to the skin, but the residue will also cause an eutrophication effect the river which results from water being polluted with abundant phosphor and nitrogen. In order to solve this problem, a high molecule solid cleaning particulate agent has been developed to substitute for the conventional washing agent. According to experimentation, when a high molecule cleaning agent is immersed in water, it can be dissolved at a very slow rate and still provide acceptable washing performance.

SUMMARY OF THE INVENTION

It is the object of this invention to provide a laundry ball wherein a high molecule solid cleaning agent can be contained therein for washing.

In order to achieve the object set forth, the laundry ball made according to this invention comprises two symmetrical semi-spherical halves of a housing, a pair of annular plates and an inner porous shell for containing a solid washing particulate therein. The porous shell is disposed within the two housing halves which are attached together by supersonically welding the two annular plates to two circumferential flanges of the halves to construct a laundry ball.

According to one aspect of the present invention, a buffer effect is provided by the annular plates and circumferential flanges to minimize collision between the semi-spherical portions of the housing and the washing machine.

According to still another aspect of the present invention, the cleaning agent is filled within the porous shell so that it will not scatter in the wash water. The porous shell is protected by the semi-spherical halves of the housing so it will not be damaged during the washing process.

Accordingly, a further aspect of the present invention involves the outer diameter of the porous shell being smaller than the inner diameter of the housing so that the porous shell may readily roll around within the housing. The cleaning agent may then smoothly dissolve to clean the clothing.

DETAILED DESCRIPTION OF THE PREFERRED EMBODIMENT

Figure 1:
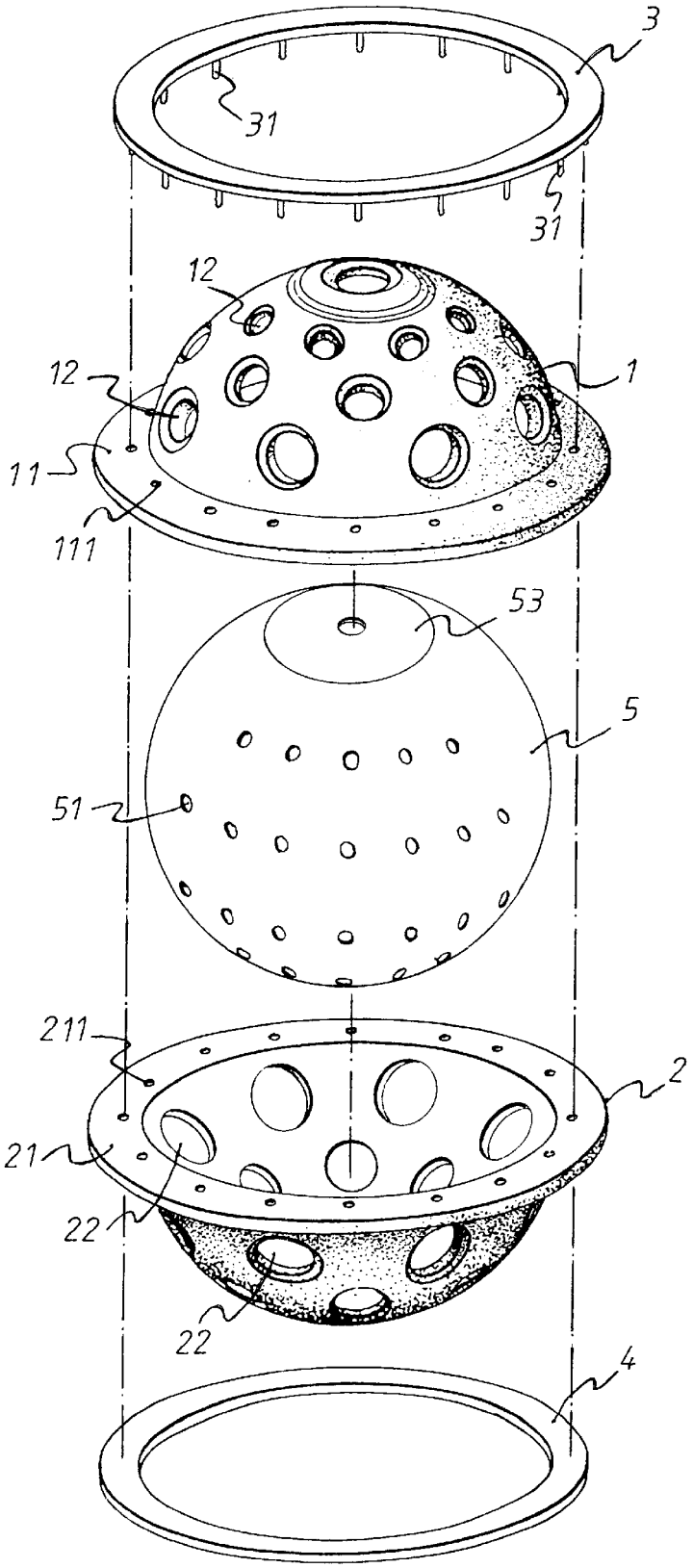
FIG. 1 is an exploded perspective view of the laundry ball made according to this invention.
Figure 2:
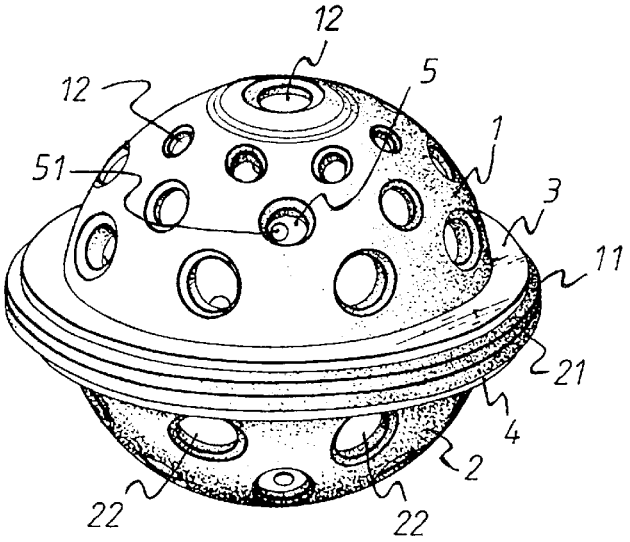
FIG. 2 is a perspective view showing an assembled laundry ball made according to this invention.
Figure 3:
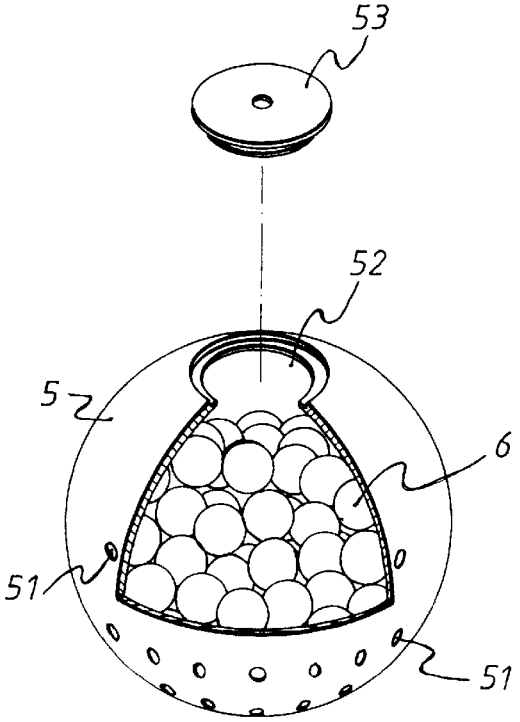
FIG. 3 is an exploded perspective view of the porous shell wherein the shell is partially cutaway to disclose its interior.

As shown in FIGS. 1 and 2, the laundry ball made according to this invention features a novel spherical vessel for containing the solid cleaning particulate 6. The laundry ball generally comprises two symmetrical semispherical halves 1, 2 of a housing, a pair of annular plates 3, 4 and a spherical porous shell 5 to be disposed between the two semi-spherical halves 1, 2.

Each of the two semi-spherical halves 1, 2 is provided with a circumferential connecting flange 11, 21 at its edge. The connecting flanges 11, 21 further include a plurality of spaced positioning holes 111, 211. The two semi-spherical halves 1, 2 further include a plurality of openings 12, 22 formed in their walls to provide communication between the interior and exterior of the housing. When the two halves 1 and 2 are assembled, a structure. resembling a ball socket is therefore constructed.

Figure 5:
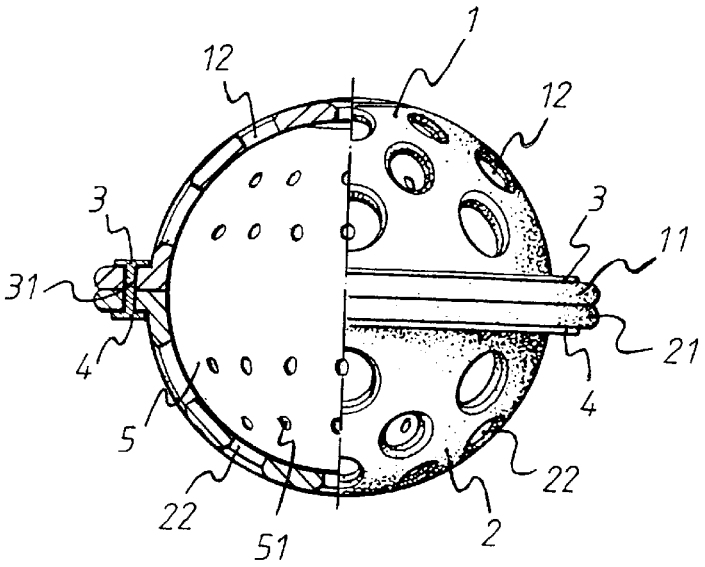
FIG. 5 is a partially sectioned side view of an assembled laundry ball showing the inside of the laundry ball.

Annular plate 3 is provided with a plurality of spaced dowel pins 31 corresponding in location to positioning holes 111, 121 of connecting flanges 11, 21. When the two halves 1, 2 are assembled and annular plate 3 is positioned wherein dowel pins 31 are received through corresponding positioning holes 111, 112, then the second annular plate 4 can be fixed to first annular plate 3 by supersonic welding to construct an I-beam configured connection therebetween at each pin 31, as shown in FIG. 5. By this arrangement, a laundry ball may be readily assembled, as shown in FIG. 2. The provision of annular plates 3, 4 and flanges 11, 21 serves to minimize collision between the spherical portions of the laundry ball and the inner wall of a washing tub.

Figure 4:
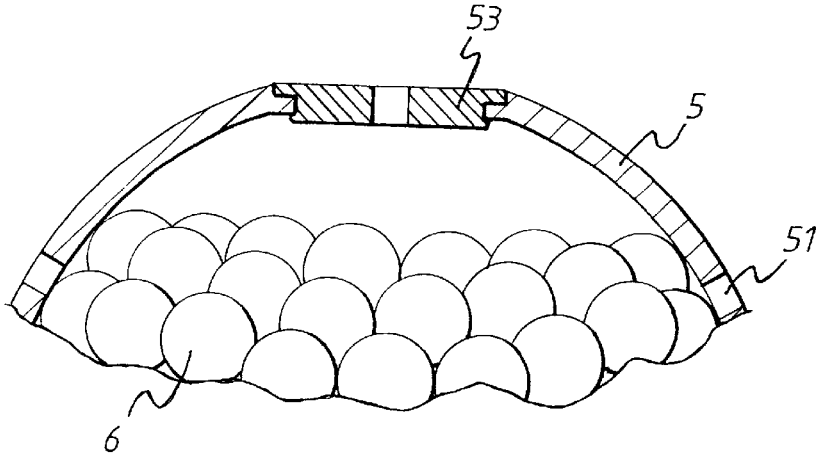
FIG. 4 is a partial cross-sectional view showing the top section of the porous shell.

The porous shell 5 is a spherical housing having a plurality of orifices 51 formed through its wall. The top of porous shell 5 is provided with an opening 52 which can be covered with a lid 53. The lid 53 is attached to said opening 52 by an interference fit therebetween. By this arrangement, the lid 53 will not fall off from opening 52, as shown in FIG. 4. When the lid 53 is removed, the cleaning particulate 6 can be filled in and the cleaning particulate will not scatter around after the lid 53 is reattached. Since porous shell 5 is disposed and protected within halves 1 and 2, porous shell 5 may not be easily damaged by the agitator of the washing machine.

In a practical embodiment of the present invention, the porous shell 5 is made from plastic material, while halves 1 and 2 of the housing are preferably made from soft plastic or foam material to prevent the clothing from being scratched or damaged. When the laundry ball is circulated within the washing tub, the cleaning particulate may be dissolved by the water and a cleaning effect may be readily attained. The laundry ball may be used many times until the cleaning particulate is exhausted, after which the ball may be discarded.

The outer diameter of the porous shell 5 is advantageously smaller than the inner diameter of the two halves 1, 2 so that the porous shell 5 may readily roll within the assembled halves 1, 2 of the housing. In light of this, the cleaning agent may be continuously dissolved within the water despite the laundry ball being enclosed by the clothing being washed.

While a particular embodiment of the present invention has been illustrated and described, it will be obvious to those skilled in the art that various other changes and modifications can be made without departing from the spirit and scope of the invention. It is therefore intended to cover in the appended claims all such changes and modifications that are within the scope of the present invention.

I claim:

1. A laundry ball for containing and dispensing a particulate cleaning agent into the water of a clothes washing machine, the ball comprising:

a) a hollow spherical housing defined by two semi-spherical half sections, each half section including a plurality of openings formed therein, a circumferential flange extending outwardly from a circular edge thereof and a plurality of position holes spaced around the flange, the position holes of the two flanges corresponding in number and location;

b) a porous spherical shell disposable within the housing for containing a particulate cleaning material, the shell including a plurality of orifices formed therein; and c) a pair of annular plates engageable on opposite sides of the flanges, one annular plate including a plurality of dowel pins for extending through the position holes of the flanges and welding to the other annular plate for securing the semi-spherical half sections together.

2. The laundry ball of claim 1 wherein the outer diameter of the porous shell is smaller than the inner diameter of the housing for permitting the porous shell to readily roll around within the housing.

3. The laundry ball of claim 1 wherein the porous shell further includes an opening for filling the shell with the particulate cleaning agent and a lid for closing the opening.

* * * * *